United States Patent [19]

Jean

[11] Patent Number: 4,878,530

[45] Date of Patent: Nov. 7, 1989

[54] BATHROOM PANEL

[76] Inventor: Marielle Jean, 25 rue Lucas, 03200 Vichy, France

[21] Appl. No.: 176,783

[22] Filed: Apr. 1, 1988

[30] Foreign Application Priority Data

Apr. 3, 1987 [FR] France ..... 87 05056
Apr. 3, 1987 [FR] France ..... 87 05057

[51] Int. Cl.[4] ..... E05D 15/00
[52] U.S. Cl. ..... 160/211; 160/213
[58] Field of Search ..... 4/607, 608, 609, 610, 4/557, 558; 160/199, 196.1, 197, 200, 206, 211, 212, 213

[56] References Cited

U.S. PATENT DOCUMENTS

| | | | |
|---|---|---|---|
| 2,331,822 | 10/1943 | Zechiel et al. | 160/206 |
| 2,833,346 | 5/1958 | Preston | 160/197 |
| 3,111,208 | 11/1963 | Grossman | 4/607 X |
| 3,750,737 | 8/1973 | Woodward | 160/206 |
| 4,358,863 | 11/1982 | Jacobsen | 4/607 |
| 4,512,045 | 4/1985 | Baus | 4/607 X |
| 4,606,081 | 8/1986 | Baus | 4/607 X |

*Primary Examiner*—Ramon S. Britts
*Assistant Examiner*—David M. Purol
*Attorney, Agent, or Firm*—Lee C. Robinson, Jr.

[57] ABSTRACT

A wall-mounted bathroom panel assembly in which the frame for each panel has two horizontal short sides and two vertical long sides which each have a longitudinally extending corner. As elongated vertical mounting member is fixed to the bathroom wall, and this mounting member also has a longitudinal corner. The corners of both the mounting member and each side of the frame define a recess of circular cross-section. A first pair of integrally connected pins are respectively disposed in the corner recess in the mounting member and in the corner recess in a long side of one of the frames to permit pivotal movement of the one frame relative to the mounting member about a vertical axis and also sliding movement along this axis. Similar pairs of integrally connected pins are disposed in the corner recesses in the short sides of adjacent frames to permit horizontal sliding movement between the frames. A weight-compensating assembly cooperates with the mounting member to restrict sliding vertical movement of the connected panel.

8 Claims, 7 Drawing Sheets

FIG. 1
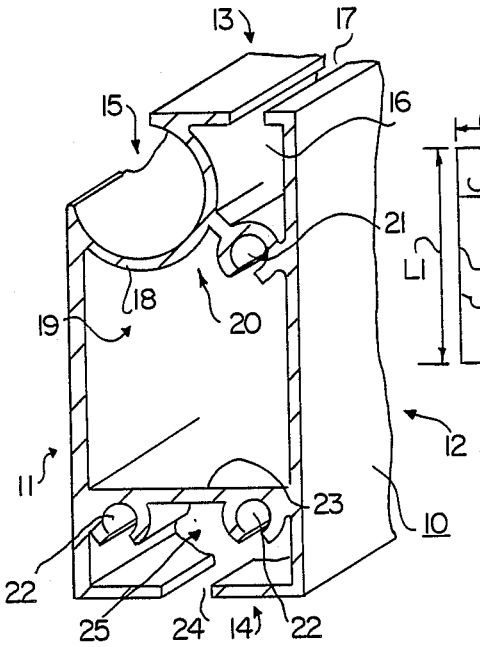
FIG. 2
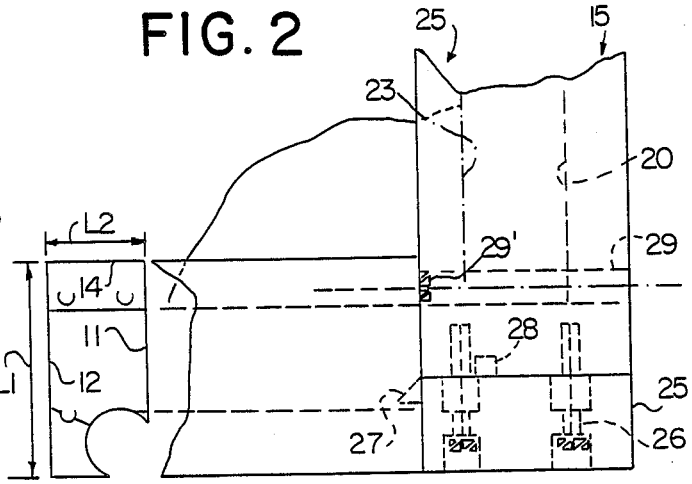
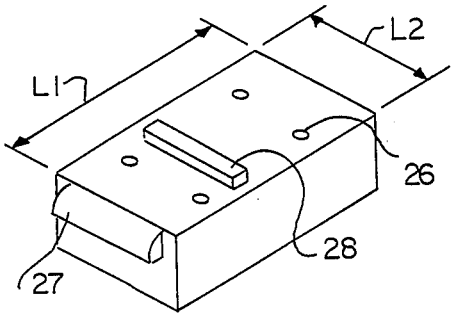
FIG. 3

BATHROOM PANEL

BACKGROUND OF THE INVENTION

The present invention relates to the field of dwelling-house utilities and has more particularly as its subject improvements to a panel assembly, or screen, intended to interact with a bathtub in order to form a shower cubicle.

A prior panel assembly for this purpose has been described in French patent application FR 82 13,597 (Ateliers de La Motte). An essential characteristic of the invention described in this prior application consists in an arrangement for the panel to be translated vertically about its axis of articulation to a mounting fixed to the wall to bring the panel above the tap fittings of the bathtub, and making it possible to cause the panel to pivot in order to bring it perpendicular to the tap fittings.

French patent application 84 06,526 (Ateliers de la Motte) discloses improvements to the abovementioned invention aimed principally at lowering the cost of manufacture of such panels.

The technological background concerning certain elements of the abovementioned inventions, namely articulation elements and weight-compensating elements, has been described in the following publications: for the former elements, French Pat. No. 2,322,247 (SORINE), German Pat. No. 1,659,607 (BRUNE), British Pat. No. 945,572 (EDUCATIONAL SUPPLY) and Canadian Pat. No. 619,269 (HICKS), for the latter, U.S. Pat. No. 3,955,239 (GROSSMAN).

SUMMARY

The aim of the present invention is to propose a functional organization for such a hinged and pivotable panel assembly, based on an improved shape.

According to the present invention, a bathroom panel assembly is mounted above the edge of a bathbut in order to be able, in particular, to use the bathtub as a shower cubicle. The panel assembly pivots about a vertical axis in order to be folded back against the wall, and it also slides along this axis to position above the tap fittings with which bathtubs are generally provided. The assembly includes weight-compensating means intended roughly to compensate for its weight, and it is made up of simple panels which can slide or pivot on one another. Each panel comprises a profile frame and a "pane" surrounded and supported by the frame. One of the panels is articulated on a mounting fixed to the wall by a double pin arrangement with the pins engaged in grooves in the frame and in the mounting. The frame includes a circular recess open along the sides of the frame, a lateral recess open by means of a passage adjacent to the circular recess, and end recess and a closed central recess. A lower wall of said lateral recess is provided with a C-shaped indentation open in the direction of said central recess, and a crosspiece of the frame is provided with two indentations open on said end recess.

The secondary parts or arrangements which will be described below make the functional organization of the panel possible.

According to the invention, a connection piece of parallelepiped shape is provided at the intersecting sides of the frame. The connection piece is provided with four countersunk holes for the passage of screws whose axes correspond to the axes of the indentations. The connection piece comprises, moreover, on two of its faces a stub which rests against the lower wall and a raised centering part.

Still according to the present invention, a piece, referred to as a sliding block, having a generally parallelepiped elongated shape, comprises, along the two large sides of a large face, two cylindrical parts each intended to be accommodated in a groove of the frame. One of these parts slides in said groove, and the other is fixed therein. Two sliding blocks are mounted on at least the upper portions of two adjacent frames, one of the sliding blocks being fixed with respect to one frame and able to slide with respect to the other, and vice versa; the result thereof is that the frames can slide on one another; it will be noted that sliding blocks are advantageously arranged in a similar manner on the lower portions of the frames.

In some embodiments of the invention joint having a hollow triangular section and which is slit at one of the angles of the triangle is clamped on one of the edges of the opening of sid end recess. The joint rests with its side which is opposite the slit against a pane passing through said opening. Two of the sides of the triangle are extended while the side opposite the slit bulges slightly towards the inside. The joint has a section largely in the shape of an F.

In addition embodiments of the invention the frame have a section which is narrowed at its center pinched between the edges facing the passage of the lateral recess, at least along the lower portions of the frames which rest on the edge of the bathtub.

According to a detail, the weight-compensating mechanism is arranged in the central recess of a mounting member fixed to the wall while flexible catching means are arranged on the adjacent frame. The catching means holds the panels in a raised position (above the level of the tap fittings) while still enabling the descent of the panels to their lower position.

Advantageously, said compensating mechanism comprises a tubular activating member and a tubular extension with square end connectors. A slot is provided in the wall of the groove along a plane joining the axis of the groove to the axis of the central recess. This slot has a length greater than the height of the tap fittings with respect to the edge of the bathtub and accommodates a pin, which is an integral part of the extension. A notch is arranged in the pin extension and accomodates the protruding head of the pin, as a result of which the pin is an integral part of the extension in translation but is free in rotation with respect to the latter.

Advantageously, said flexible catching means comprises a resilient piece which may be accommodated in said end recess of the frame to form a mounting by virtue of a cutout in the parts defining said recess. The resilient piece includes two projections which extend in the path of the lower connector of the extension. The projections retract during the slightly forced passage of the connector but remain extended under the apparent weight of the panel.

BRIEF DESCRIPTION OF THE DRAWINGS

The present invention will be better understood and the details thereof will emerge from the description which will be made of particular embodiments and applications, with respect to the figures on the appended sheets, in which:

FIG. 1 is a fragmentary perspective view, partly in, of a panel frame in accordance with an illustrative embodiment of the invention;

FIG. 2 is a fragmentary elevational view of a connection piece for frames;

FIG. 3 is a perspective view of the connection piece used in the example if the preceding figure;

DESCRIPTION OF CERTAIN PREFERRED EMBODIMENTS

Figures 4, 4A, 5, 6:
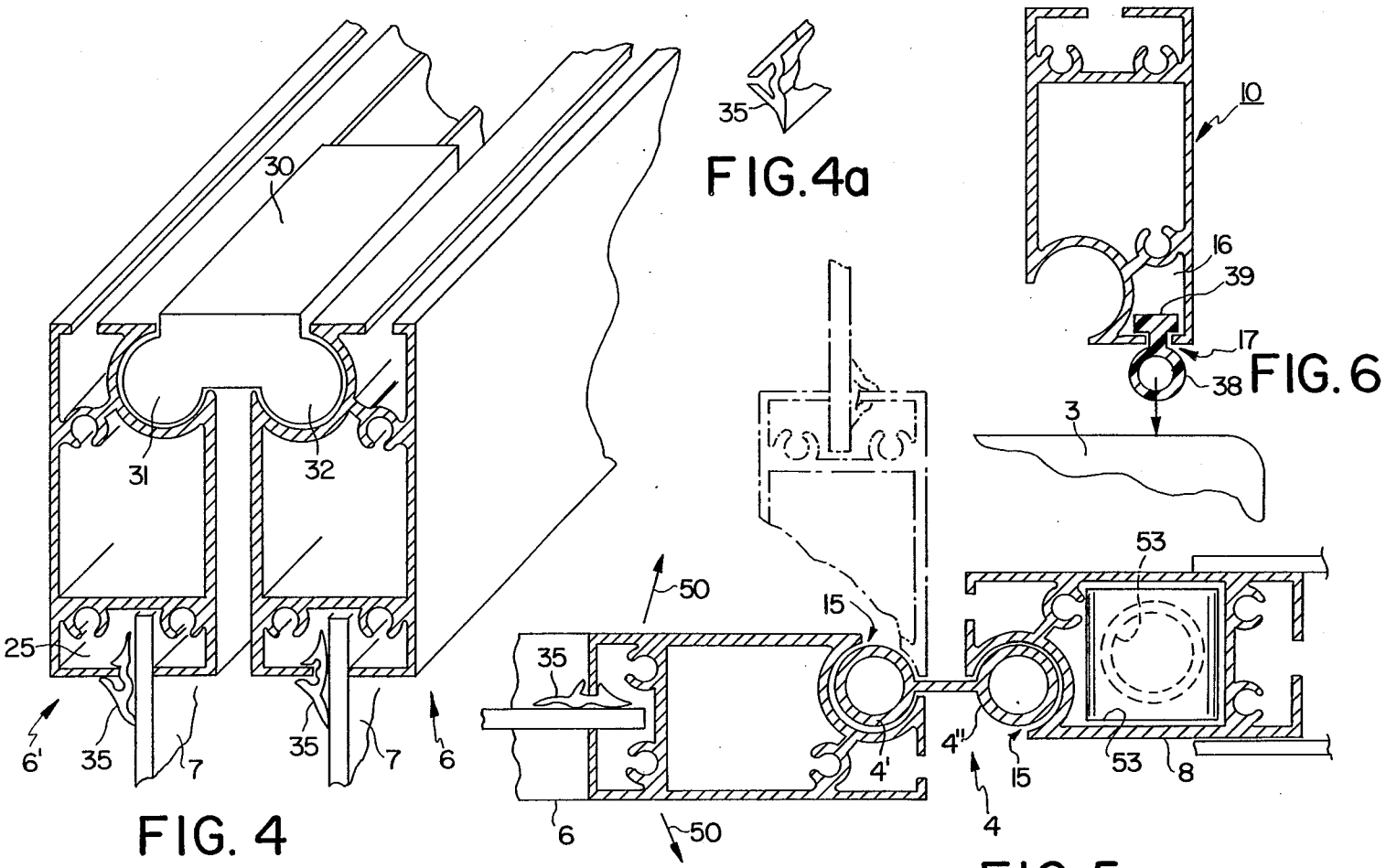
FIG. 4 is a fragmentary perspective view, partly in section, of two adjacent panel frames.
FIG. 4*a* is a fragmentary perspective view of one of the joint members illustrated in FIG. 4.
FIG. 5 is a horizontal sectional view of the hinge assembly connecting adjacent frames.
FIG. 6 is a vertical section view of a contact joint of a frame with the edge of the bathtub.
Figure 7:
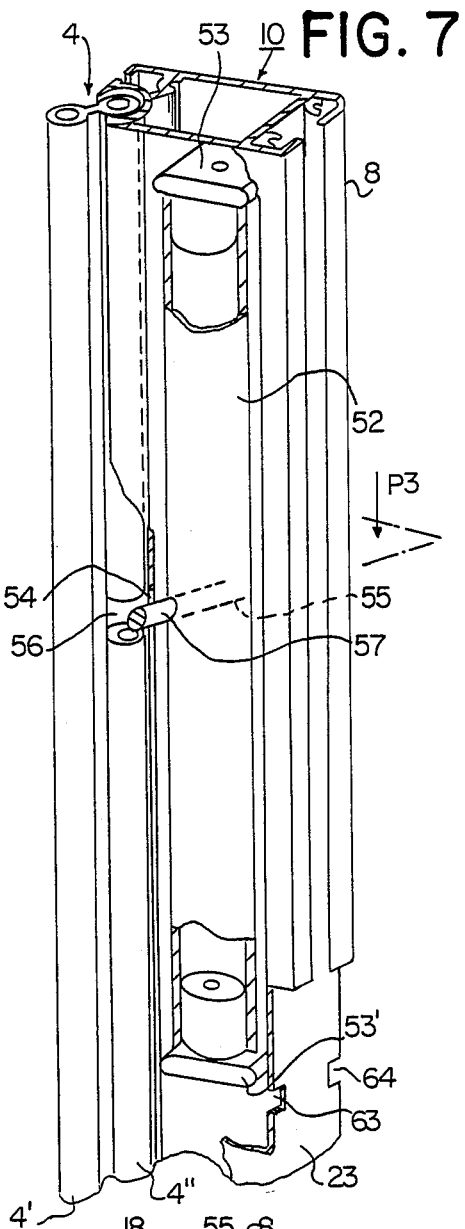
FIG. 7 is a perspective view, with portions shown in section, illustrating the interaction of an extension member with the hinge of the frame.

In FIG. 1, a panel frame 10, for example made of extruded aluminum, has a transveerse cross section with a substantially rectangular bulk defined by the faces 11, 12, 13, 14 of the frame. The frame comprises a circular recess 15 open at one of the longitudinlly extending corners of each side of the frame, and defined by a ring sector 18. A lateral recess 16 open by means of a passage 17 on a first small face 13 of the frame, and end recess 25 communicating with an opening 24 on the second small face 14 of the frame, substantially towards the center of said small face, and a central closed recess 19. The recess 19 is defined by the ring sector, by means of a lower wall 20 of said lateral recess, said wall comprising a C-shaped indentation 21 open in the direction of said central recess, by means of the two large faces 11, 12 of the frame, and by a crosspiece 23 having two indentations 22 open on said end recess.

In FIGS. 2 and 3, a connection piece 25, having a generally rectangular shape, has as its first dimension L1 the length of one large face 11, 12 of th frame and for its second dimention L2 the length of a small face 13, 14. The connection piece is provided with four countersunk holes, such as 26, at locations corresponding to those of the indentations 21, 22. A stub 27 is located on a small face of the connection piece in position to be inserted in the central recess 19 and to rest against the raised parts of the lower wall 20. The connection piece also includes a raised centering part 28 on one of its large faces which fits between the large faces 11, 12 of the frame. In this embodiment, the screw passages 29 receive screws 29′ which engage in the indentations 22.

In FIG. 4, a sliding block 30 has a generally parallepiped shape but is provided with two cylindrical parts 31, 32 on its lower face. Each of the parts 31, 32 is disposed in one of the circular recesses 15 of adjacent frames. One of the cylindrical parts is adhesively bonded, or otherwise locked, in its circular while the other is free to move therein. Two sliding blocks 30, 30′ (FIG. 10) are mounted on the upper portions of two adjacent frames 6, 6′. The sliding block 30 is fixed in the circular recess of the frame 6 while the sliding block 30′ is fixed in the circular recess 15 of the frame 6′ and each of the blocks is arranged to slide in the circular recess of the other frame. A similar arrangement of sliding blocks may be provided on the lower part of the frames.

In FIG. 4, a profile joint 35 pinches one of the edges of the opening 24 of the recess 25. The joint 35 has a slit for receiving this edge, and it rests with its side which is opposite its slit against the pane 7 which itself penetrates into said opening. FIG. 4*a*, on a larger scale, illustrates the joint 35 as a hollow triangular section split at one of the angles of the triangle. Two of the sides of the triangle are extended while the third side which is opposite the slit bulges slightly inwards, and is tapered at its end. This joint 35 is introduced by virtue of its tapered side into the slits 24 after the panes have been mounted in the frames.

In FIG. 6, a profile joint 38, made of a resilient material, is pinched between the edges forming the passage 17 of the lateral recess 16 of a lower frame. The joint 38 has a narrowed section at its center, a full part 39 and a thin-walled tubular part 38. In the position represented in FIG. 10, the tubular part of the joint is squashed against the edge 3 of the bathtub.

In FIG. 5, there is illustrated, by sectioning a horizontal plane, the way in which the panels are articulated against a mounting fixed to the wall. In a known manner, a male member 4 forms two pins 4′,4″ has each of its pins engaged in the circular recesses 15 of the frame 6 and of the mounting 8. However, it will be noted that according to a characteristic of the invention, the adjacent frame 6 and the mounting 8 are arranged in a symmetrical manner with respect to a line which may be the axis of symmetry of the male member 4, and not with respect to a plane. The arrangement of the axial symmetry in this manner permits the panel to be folded back both on one side and on the other (arrows 50), which prevents the hinge being forced accidentally which would be the case if the arrangement of planar symmetry had been adopted.

In FIGS. 7 to 10, a weight-compensating mechanism comprises a tubular activating member 51, such as a penumatic jack or coil spring for example, and a tubular extension 52 with square end connectors 53, 53′ having rounded edges (see also FIG. 5). The extension rests on the upper end of the activating member 51; it comprises, screwed into its center, a pin 55 the head of which protrudes to a great extent. The head 57 is inserted in a longitudinal slot 54 in the ring sector 18 of the mounting 8, the slot 54 extending over a height H1 slightly above the height H2 corresponding to the highest point of the tap fitting 9 above the edge 3 of the bathtub; head is located in a notch 56 provided in the pin 4″ so as to make the male profile 4 an integral part in translation of the extension 52 when the head of the pin 57 is disposed in the slot 54.

Figure 8:
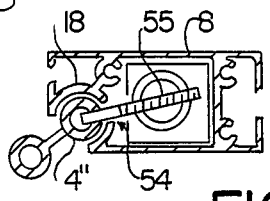
FIG. 8 is a transverse section of the hinge and frame shown in the preceding figure.
Figure 8A:
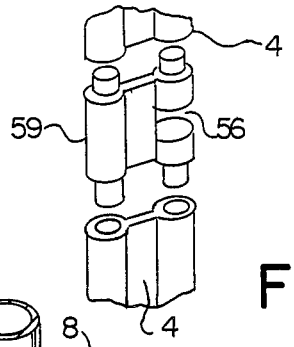
FIG. 8*a* is a fragmentary perspective view illustrating a connection piece and associated parts for the panel sections.

In FIG. 8*a*, there is represented an alternative implementation of the slot 56, according to which variant the slot is included in a connection piece 59, for example made of plastic material which may be inserted between two members 4 and which has the same section.

Figure 9:
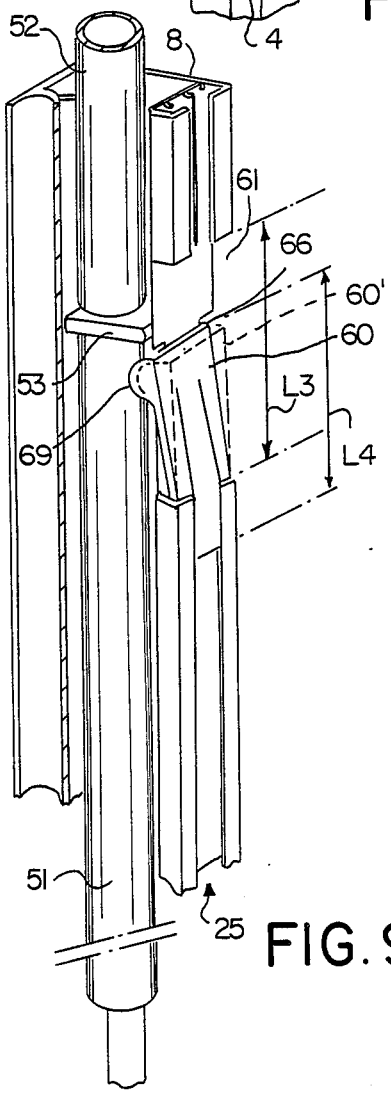
FIG. 9 is a perspective view of the parts lying below the extension of FIG. 7.
Figure 10:
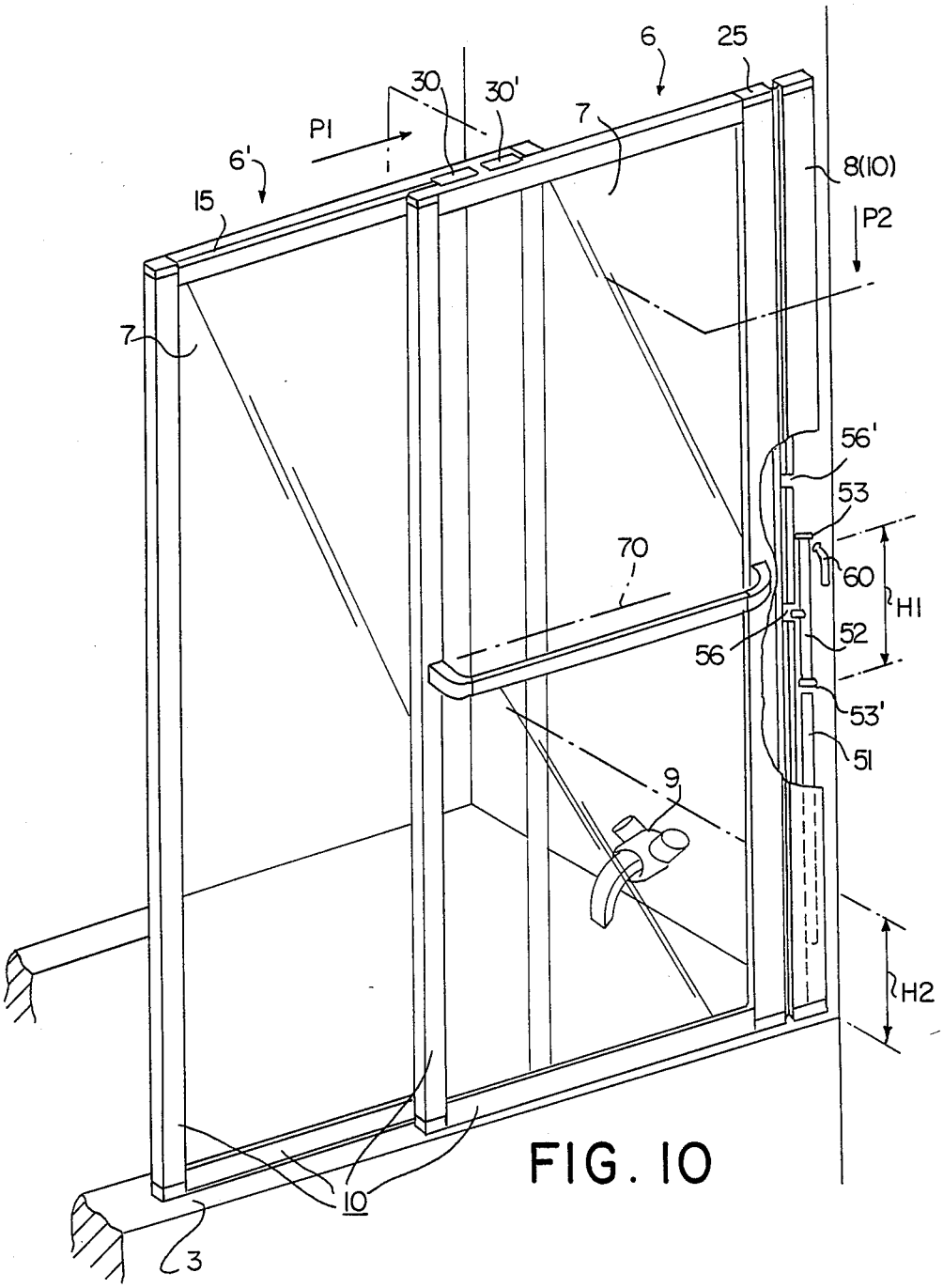
FIG. 10 is a perspective view illustrating a panel mounted on a bathtub.

In FIGS. 9 and 10, more particularly, the square end connectors 53, 533' interact with a resilient piece 60 having two rounded projections such as 65 and 66 (only the projection 65 is clearly visible) in order to form a flexible catching assembly. The projections 65 and 66 penetrate into the central recess by means of two orifices 63, 64 provided in the crosspiece 23 (FIG. 7) so as to interfere in the path of the end connectors, such as the lower end connector 53' in the case of this figure. The piece 60 is inserted in the end recess 25 by virtue of a cutout 61 of length L3 which is slightly greater than the length L4 of the piece 60. When the end connector 53' passes either upwards or downwards perpendicular to the projections 65 and 66, it causes bending of the piece 60 to the position shown by the dotted line 60. In particular, if the assembly of the panels has a light apparent weight, the catching mechanism will exert sufficient force to maintain the panels in a raised position because of the engagement of the projections 65 and 66 with the end connector. A slight manual pressure on the panels, however, causes the projections to move out of the path of the end connector due to the flexing of the piece 60, and the panels may be returned to their lower position.

In FIG. 10, there will be found, diagrammatically, the members of the mechanism shown in the preceding figures. It will be observed therein, however, that a seecond notch 56' is provided which is symmetrical with the first notch 56 with respect to the median line 70 of the panel. This second notch will be used to convert a panel folding to the left of the mounting 8 into a panel folding to the right, which is fairly often needed by the arrangement of bathtubs.

Figure 11:
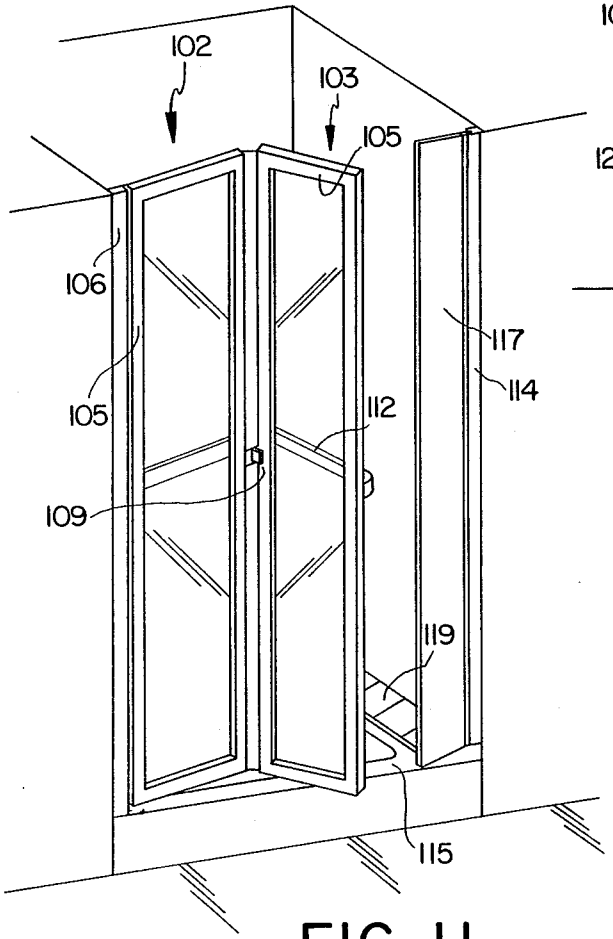
FIG. 11 is a perspective view of a panel assembly used with a shower cubicle.

In FIG. 11, a shower cubicle door is made up of two panels 102 and 103 surrounded by frames 105 made of, for example, aluminum. The panel 102 is articulated to a frame-lining mounting 106 fixed to the wall. A second frame-lining mounting 11 4 has an F-shaped cross-section and is attached to a folding-back panel 117. The panel 103 is flush with the rear face of the panel 17 when the door is closed; the floor of the shower cubicle is made up of a tray 115.

Sometimes the tray has a width smaller than that of the cubicle. In this case, it is necessary to construct a connection between the tray and the wall, a connection which is generally covered with tiles 119. The function of the folding-back panel 117 is precisely to enable a prefabricated door to be matched to the varying widths of shower cubicles, within a certain width range. It will be noted that the panel 117 is cut away at its lower end so that it is possible for it to be adapted to any slope of the tiles.

Figure 12:
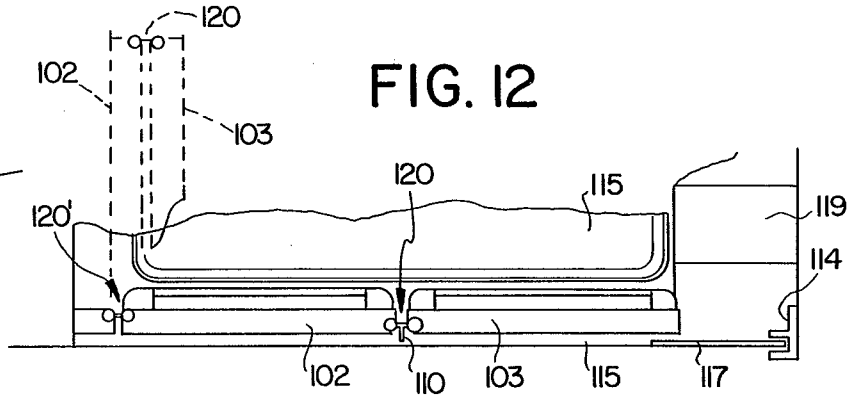
FIG. 12 is a top plan of a portion of the preceding figure.

In FIG. 12, the panel 103 is articulated to the panel 102 by means of a first hinge 120, and the panel 102 is articulated to the mounting 106 by a hinge 120'. In the closed position the end of the panel 103 is located behind the folding-back panel 117. In this figure it will be noted that the F-shaped mounting 14 is adhesively bonded to the wall along its back with the vertical edge of the folding-back panel 117 inserted between its branches.

The hinge 120, within the scope of the invention, includes a piece 109 (FIG. 13) comprising two circular ring parts connected together by means of a median part. A web 110 extends perpendicular to the intermediate part and acts as a pull handle.

Figure 14:
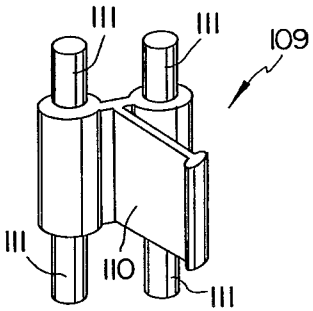
FIG. 14 is a perspective view of one of the parts illustrated in the preceding figure.

In FIG. 14 it is shown that the piece 109 is provided with cylindrical stubs 111 which are embedded forcibly into corresponding recesses in the parts of the frame having a ring section.

Figure 13:
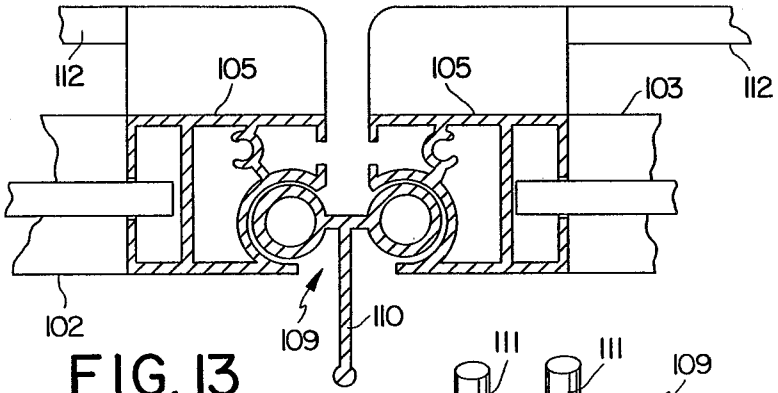
FIG. 13 is a section along a horizontal plane of a portion of the preceding figure on a larger scale.

In FIGS. 11 to 13, it will be noted that the transverse bars 112, acting as hand grips, are fixed to the internal sides of the panels 102 and 103, these bars also accomodating articles such as washing gloves or towels.

Figure 15:
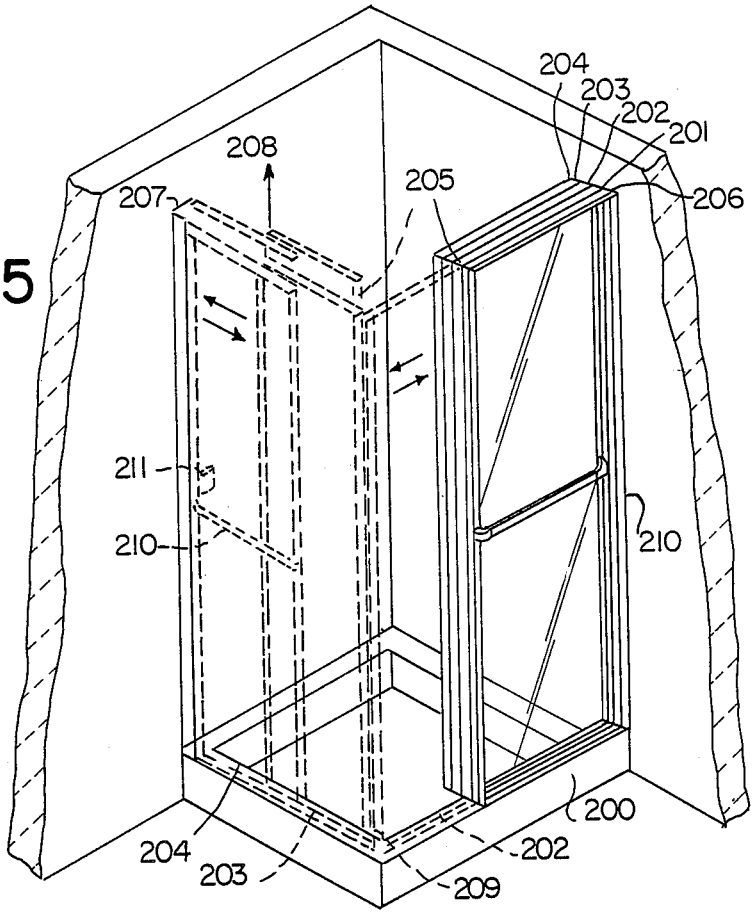
FIG. 15 is a perspective view of another embodiment of the invention.
Figure 16:
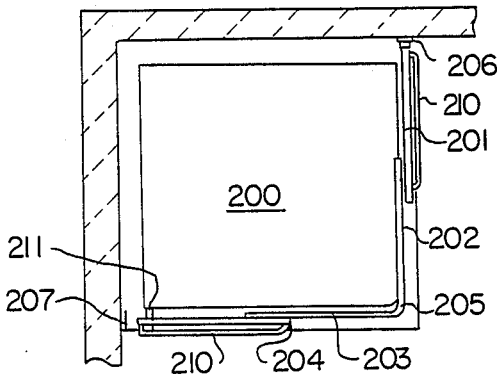
FIG. 16 is a top plan of the embodiment of the preceding figure.
Figure 17:
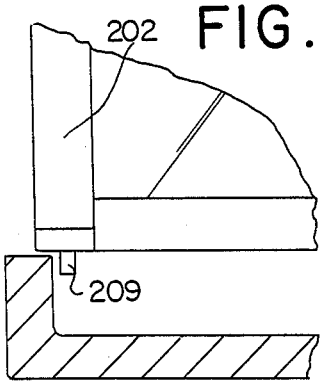
FIG. 17 is a vertical section illustrating a detail of FIG. 15.

In FIGS. 15 to 17, a screen is placed upon a shower tray 200 to prevent water being projected over the two sides of the tray. The screen comprises two assemblies of similar panels 201, 202 and 203, 204. Each assembly comprises two panels sliding one over the other (202 over 201 an 204 over 203). One of the panels, 201 for example, is fixed solidly to the wall by means of a U-shaped member 206. The two assemblies are joined at the junction of the two other panels 202, 203 by a hinge 205 having a clearance which allows a slight vertical displacement in the direction of the arrow 208. A stop stub 209 is advantageously arranged at the base of one of the panels, such as 202, in order to restrict the folding back of the panels to the surface of the tray.

Figure 18:
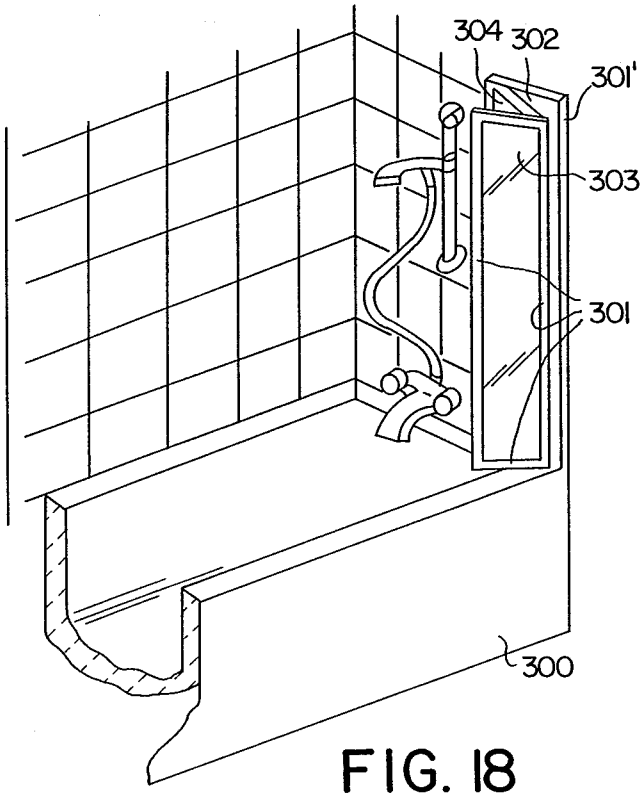
FIG. 18 is a perspective view of still another embodiment of the invention.

In FIG. 18, a screen for a bathtub or shower tray comprises several folding panels 302, 304, each panel comprising a profile frame 301 and a pane. Each of the panels has a width less than the distance between the end of the tap fittings and the external edge of the bathtub 300. The panel 302 is articulated on the wall along its edge 301'.

In all the drawings, the frames for the panels, such as the frames 10, 105, 301 and the frames of the panels 201 to 204, are similar and comply with the description given above for the frame 10.

Although particular and preferred embodiments of the invention have been described and represented, it should be understood that the scope of the latter is not limited to this embodiment but extends to any panel for converting a bathtub into a shower cubicle comprising, taken separately or in combination, the general or particular characteristics specified in the description.

I claim:

1. A wall-mounted bathroom panel assembly comprising, in combination, at least one panel having a rectangular frame and a pane surrounded by and supported by the frame, said frame including two horizontal short sides and two vertical long sides which each have a longitudinally extending corner;

an elongated vertical mounting member fixed to the bathroom wall and having a longitudinal corner extending in a direction parallel to the long sides of said frame, said corner of the mounting member and said corner of each of the sides of said frame each defining a recess of circular cross-section;

pin means connecting one of the long sides of the frame of said panel to said mounting member for pivotal movement about a vertical axis and for sliding movement along said axis, said pin means having a pair of integrally connected pins respectively disposed in the corner recess in said mounting member and in the corner recess in said one long side of the frame; and weight-compensating means cooperating with said mounting member and said panel for restricting sliding vertical movement therebetween.

2. A wall-mounted bathroom panel assembly as defined by claim 1, wherein each of the sides of said frame is of hollow configuration to define an internal recess and includes an interior wall therein; and a connection piece for joining each long side of the frame with the adjacent short side, said connection piece including a stub resting against said interior wall and a raised centering piece disposed in said internal recess.

3. A wall-mounted bathroom panel assembly as defined by claim 1, in which one of said pins is slidably disposed in the corner recess therefor and the other pin is fixed in its corresponding recess.

4. A wall-mounted bathroom panel assembly as defined in claim 1, in which said frame includes a pair of spaced edges defining a longitudinally extending opening in at least one of said sides, and a joint member of generally triangular cross-section and defining a slit at one of the apexes of the triangle, one of said spaced edges being clamped in said slit by said joint member, said joint member bearing against said pane to hold the pane in place on said frame.

5. A wall-mounted bathroom panel assembly as defined in claim 1, in which said frame includes a pair of spaced edges defining a longitudinally extending opening in one of said sides, and a resilient member extending through said opening, the resilient member having an enlarged portion inwardly disposed with respect to said opening and an external tubular portion.

6. A wall-mounted bathroom panel assembly as defined in claim 1, in which the weight-compensating means includes a flexible catching member carried by the mounting member.

7. A wall-mounted bathroom panel assembly as defined in claim 6, in which the flexible catching member includes a pair of projections thereon, said projections retracting in response to manual pressure to permit relative sliding movement along said vertical axis between said panel and said mounting member.

8. A wall-mounted bathroom panel assembly comprising, in combination, a plurality of panels each having a rectangular frame and a pane surrounded by and supported by the frame, said frame including two horizontal short sides and two vertical long sides which each have a longitudinally extending corner;

an elongated vertical mounting member fixed to the bathroom wall and having a longitudinal corner extending in a direction parallel to the long sides of said frame, said corner of the mounting member and said corner of each of the sides of said frame each defining a recess of circular cross-section;

first pin means connecting one of the long sides of the frame of a first of said panels to said mounting member for pivotal movement about a vertical axis and for sliding movement along said vertical axis, said first pin means having a first pair of integrally connected pins respectively disposed in the corner recess in said mounting member and in the corner recess in said one long side of the frame of said first panel;

second pin means connecting one of the short sides of the frame of said first panel to one of the short sides of the frame of a second of said panels to permit sliding movement between said first and second panels, said second pin means having a second pair of integrally connected pins respectively disposed in the corner recesses in said short sides of said first and second frames; and weight-compensating means cooperating with said mounting member and said first panel for restricting sliding vertical movement therebetween.

* * * * *